US006604959B2

(12) United States Patent
Martin et al.

(10) Patent No.: US 6,604,959 B2
(45) Date of Patent: Aug. 12, 2003

(54) ELECTRICAL CONNECTOR TERMINATION TOOL

(75) Inventors: Dale D. Martin, East Lyme, CT (US); Rudolph A. Montgelas, West Hartford, CT (US); Glenn T. Kierstead, Coventry, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/043,256

(22) Filed: Jan. 14, 2002

(65) Prior Publication Data

US 2003/0134535 A1 Jul. 17, 2003

(51) Int. Cl.[7] ..... H01R 13/58
(52) U.S. Cl. ..... 439/460; 174/65 R
(58) Field of Search ..... 439/460, 449, 439/468, 942, 457, 470, 442; 174/65 R, 60; 29/750, 758; 379/456

(56) References Cited

U.S. PATENT DOCUMENTS

| | | | | |
|---|---|---|---|---|
| 2,647,424 A | | 8/1953 | Gordon | |
| 2,960,953 A | | 11/1960 | Schneider | |
| 3,598,900 A | * | 8/1971 | Drake | 174/138 F |
| 3,617,612 A | * | 11/1971 | Patton | 174/65 R |
| 3,640,519 A | | 2/1972 | Halstead | 29/254 |
| 4,164,812 A | | 8/1979 | Dragisic | 29/749 |
| 4,449,015 A | * | 5/1984 | Hotchkiss et al. | 174/138 F |
| 4,648,674 A | * | 3/1987 | Sanchez, Jr. | 439/395 |
| 4,701,139 A | * | 10/1987 | Good et al. | 439/497 |
| 5,155,900 A | | 10/1992 | Grois et al. | 29/758 |
| 5,606,793 A | | 3/1997 | Gross et al. | 29/760 |
| 5,624,274 A | * | 4/1997 | Lin | 439/417 |
| 5,699,608 A | | 12/1997 | Nakamura | 29/747 |
| 5,860,205 A | | 1/1999 | Davis | 29/750 |
| 6,428,364 B2 | * | 8/2002 | Saito et al. | 439/736 |

OTHER PUBLICATIONS

Versatap Modular System distributed by Graybar; Allen Tel Products, Inc. No Date.
Workstation Outlets, 110Connect Inserts and Accessories; Tyco Electronics. No Date.
T&A, Tools & Accessories Solution, The Hand Held Termination Aid and IC110 Punch Down Tool and Replacement Blades; ICC. No Date.
Tools & Accessories, Hand Held Termination Aid, IC110 Punch Down Tool & Replacement Blades, UTP Cable Stripper Tool, Modular Coupler, Duplex Modular Coupler; ICC. No Date.
Tools & Testers; Impact Tool, SBT, Palm Guard; Sieman. No Date.

* cited by examiner

*Primary Examiner*—Khiem Nguyen
*Assistant Examiner*—Hae Moon Hyeon
(74) *Attorney, Agent, or Firm*—Tara L. Hoffman; Alfred N. Goodman

(57) ABSTRACT

A tool for terminating wires to electrical connectors includes an outer body configured to fit with an operator's hand and a first receiving member mounted in the outer body for releasably holding an electrical connector in place within the outer body. A first wire guide slot is located at a first end of the outer body remote from the first receiving member. The first slot is aligned with the first receiving member to align wires located in the first slot with the electrical connector held by the first receiving member.

56 Claims, 4 Drawing Sheets

ELECTRICAL CONNECTOR TERMINATION TOOL

FIELD OF THE INVENTION

The present invention relates to a tool for aiding in the termination of cable wires to an electrical connector. More specifically, the present invention relates to a tool having a receiving member that supports the electrical connector during termination of cable wires to the electrical connector.

BACKGROUND OF THE INVENTION

Termination of cable wires or pairs to an electrical connector, such as a category five or category six jack, is conventionally accomplished by lacing the cable wires into termination or insulation displacement contact towers of the jack, placing the jack with the wires laced therein in the one of the operator's hand, and using a standard punch down tool to terminate the wires to the towers of the jack. The stuffer cap of the jack can then be placed over the termination towers and the jack installed in a wall or wall plate.

This conventional practice often results in injury to the operator when the punch down tool is misused or slips and the blades of the punch down tool injure the operator's hand. Additionally, the stuffer cap of the jack can be easily misplaced because the operator does not have a convenient place to store the cap during termination of the cable wires to the jack.

SUMMARY OF THE INVENTION

Accordingly, an object of the present invention is to provide a tool that allows the operator to safety terminate cable wires to an electrical connector.

Another object of the present invention is to provide a tool that can accommodate a variety of electrical connectors.

Yet another object of the present invention is to provide a tool that is ergonomically designed to fit to the operator's hand.

Still another object of the present invention is to provide a tool that can be used by either left or right handed operators.

The foregoing objects are basically attained by a tool for terminating wires to electrical connectors including an outer body that is configured to fit with an operator's hand and a first receiving member mounted in the outer body for releasably holding an electrical connector in place within the outer body. A first wire guide slot is located at a first end of the outer body remote from the first receiving member, the first slot is aligned with the first receiving member to align wires located in the first slot with the electrical connector held by the first receiving member.

The foregoing objects are also attained by a tool for terminating wires to electrical connectors, including an outer body configured to fit with an operator's hand having a compartment disposed therein and an electrical connector received within the compartment of the outer body. A wire guide slot is located at an end of the outer body remote from the compartment, the slot receives wires and is aligned with the compartment thereby aligning the wires located in the slot with the electrical connector held by the compartment.

The foregoing objects are also attained by a tool for terminating wires to electrical connectors, including an outer body configured to fit with an operator's hand, the outer body includes a main support wall having an outer edge and a peripheral wall that extends from the outer edge thereby forming a receiving area therebetween. First and second compartments are mounted on the main support wall and in the receiving area of the outer body for releasably holding electrical connectors in place within the receiving area of the outer body. First and second wire guide slots are located at opposite ends of the outer body. The first slot is remote from and aligned with the first compartment to align wires located in the first slot with the electrical connector held by the first compartment. The second slot is remote from and aligned with the second compartment to align wires located in the second slot with the electrical connector held by the second compartment.

Other objects, advantages and salient features of the invention will become apparent from the following detailed description, which, taken in conjunction with annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
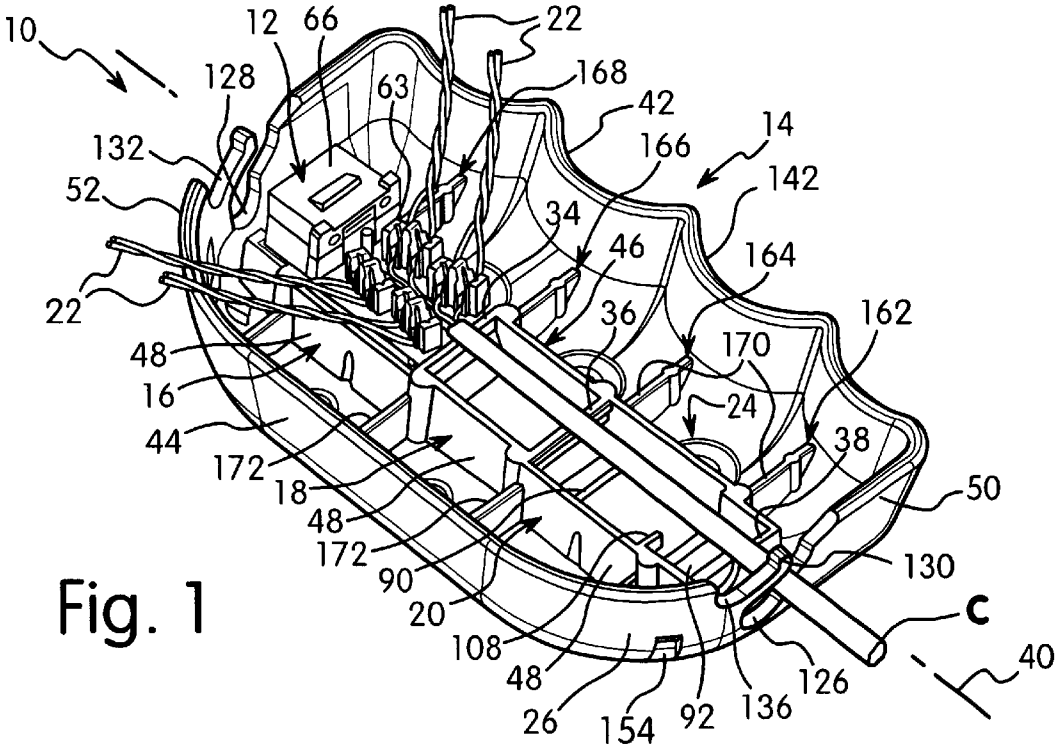
FIG. 1 is a top perspective view of a tool in accordance with an embodiment of the present invention, showing a first electrical connector and cable wires received in the tool in preparation for termination.

Referring to FIGS. 1–11, a tool 10 for terminating wires to an electrical connector 12, in accordance with an embodiment of the present invention generally includes an outer body or shell 14 that has at least one receiving member 16 disposed therein for supporting the electrical connector 12. Tool 10 supports the electrical connector 12 when terminating cable wires 22 of cable C with the electrical connector 12 using a standard punch down tool (not shown). Tool 10 protects the operator's hand when using the punch down tool to terminate the wires 22 to electrical connector 12.

Figure 9:
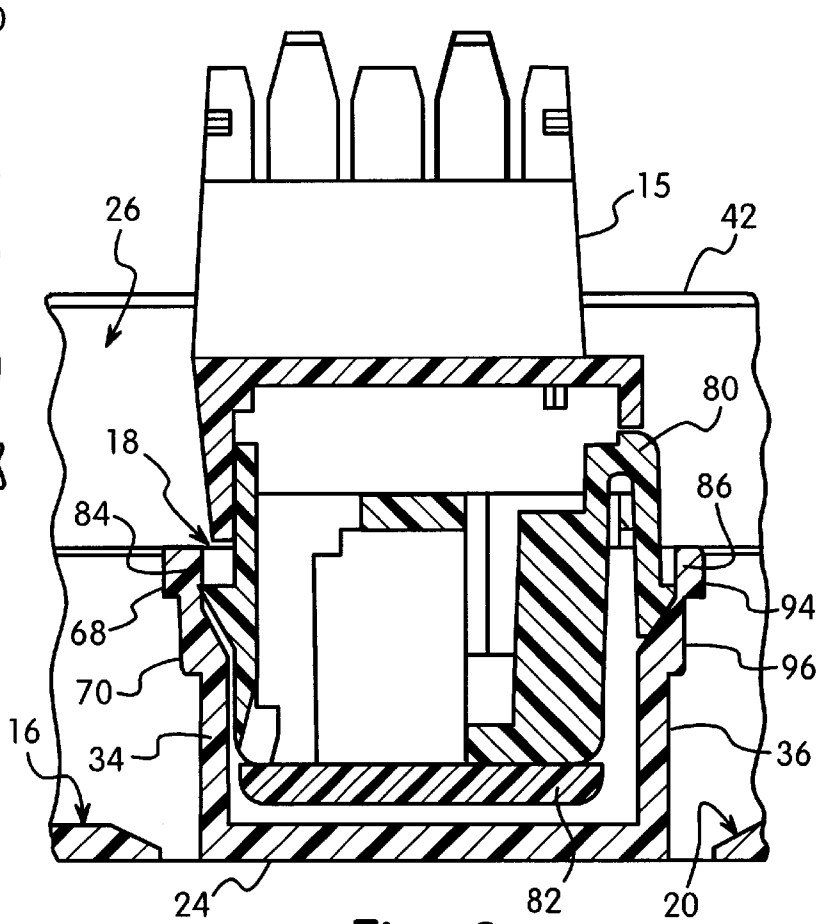
FIG. 9 is a partial, side elevational view in section of the tool illustrated in FIG. 1, showing a second electrical connector held by the tool.
Figure 8:
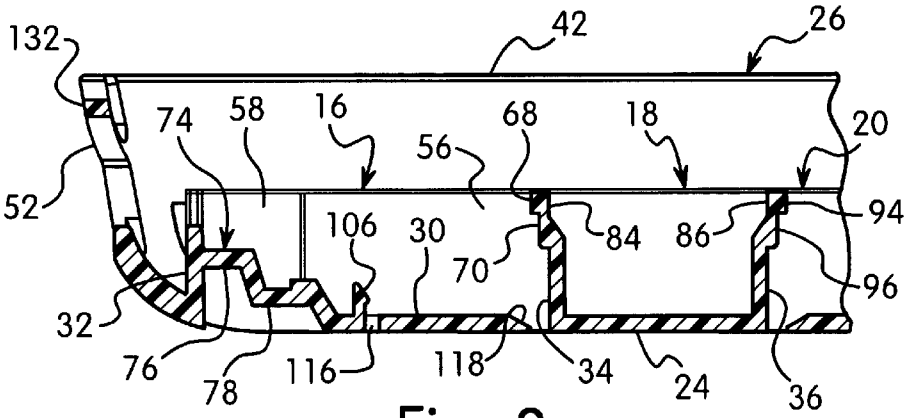
FIG. 8 is a partial, side elevational view in section of the tool taken along line 8—8 of FIG. 2.

Outer body 14 of tool 10 generally includes a main support wall 24 and a peripheral wall 26 extending from the outer edge of support wall 24 forming a receiving area 28 therebetween. Support wall 24 and peripheral wall 26 of outer body 14 are ergonomically designed and configured to fit within the operator's hand. Receiving member 16 is mounted on an inner surface 30 of support wall 24, as seen in FIGS. 1 and 8. Two other receiving members 18 and 20 are also mounted on body support wall inner surface 30 and are aligned with receiving member 16. Receiving member 18 holds another electrical connector 15, as seen in FIG. 9, which is a different type of electrical connector than connector 12. Receiving member 20 is the mirror image of receiving member 16 and holds the same type of electrical connector as connector 12. Since receiving members 16 and 20 are disposed near opposite ends of tool 10, an operator can select the more convenient receiving member between members 16 and 20 depending on whether the operator is left or right handed. Although three receiving members 16, 18, 20 are preferable, just one receiving member can be used.

Figure 2:
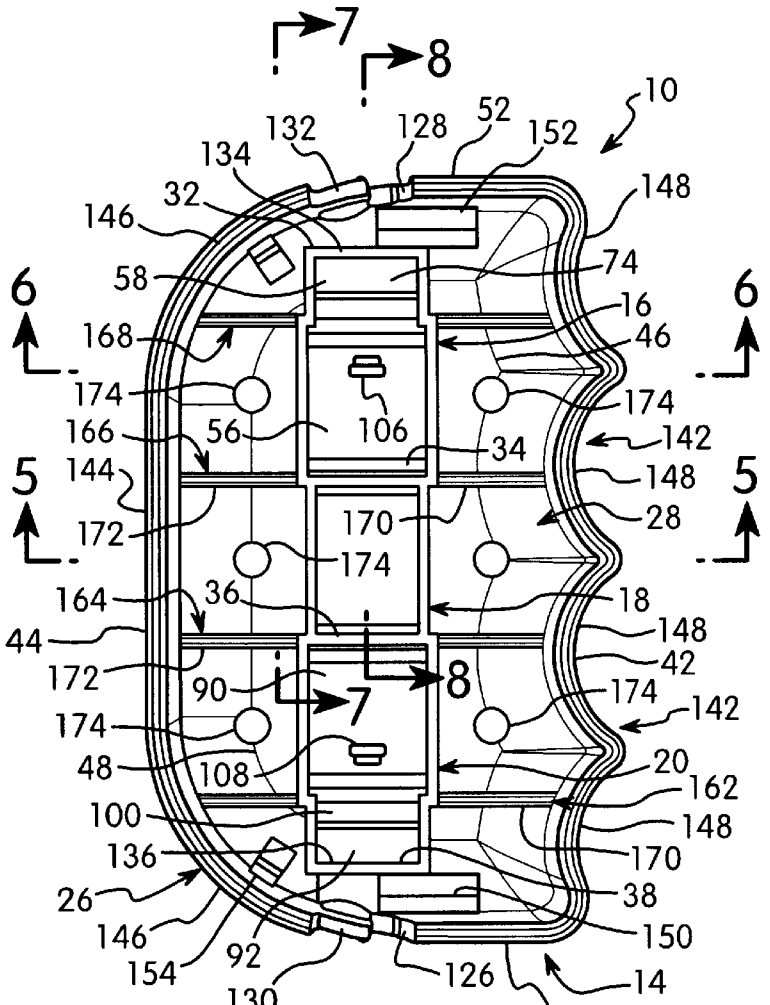
FIG. 2 is a top plan view of the tool illustrated in FIG. 1.
Figure 11:
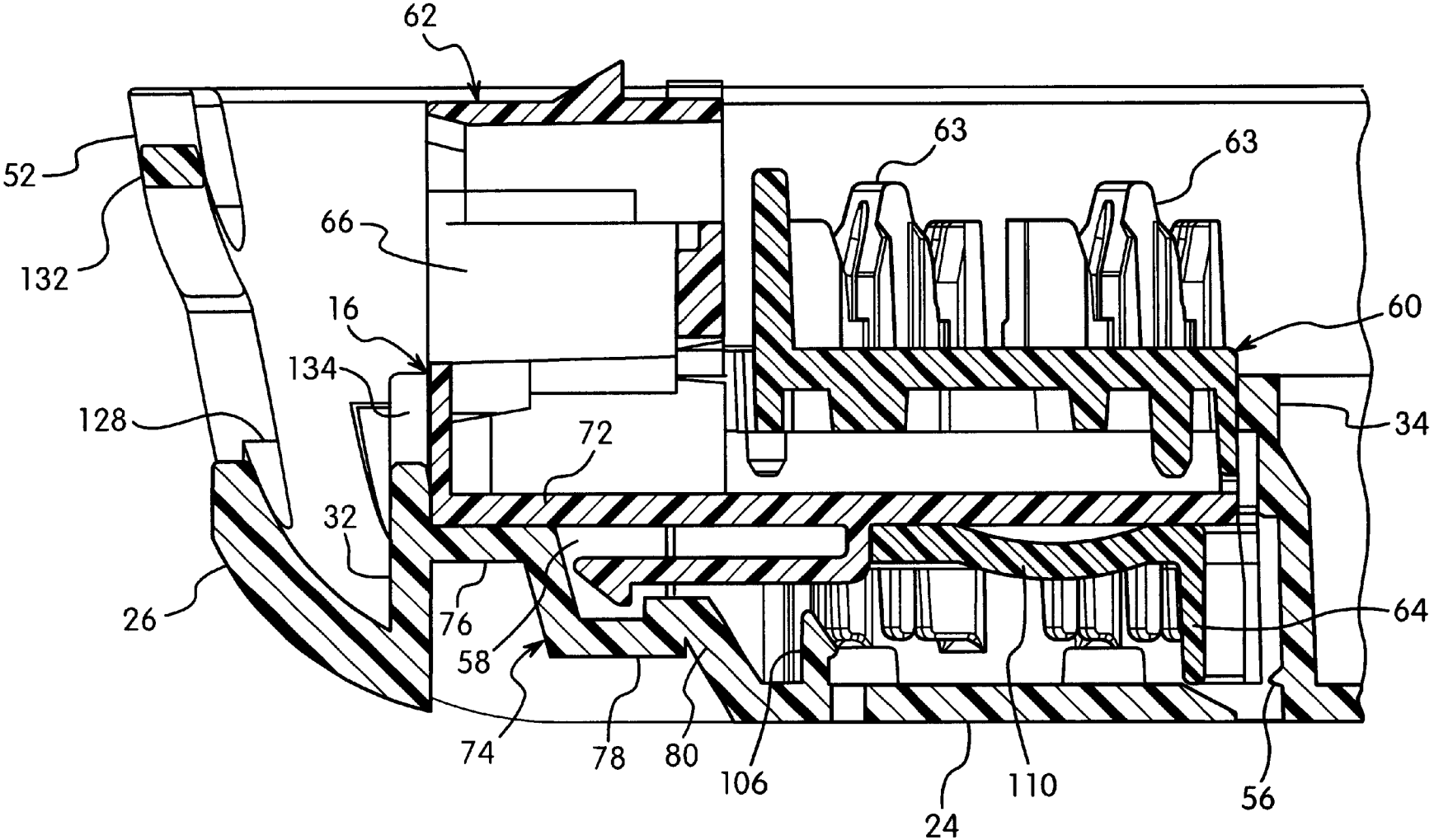
FIG. 11 is a partial, side elevational view in section of the tool illustrated in FIG. 1, showing the first electrical connector held by the tool.

Each receiving member 16, 18, and 20 forms a generally open faced compartment, as seen in FIGS. 1 and 2. The receiving members 16, 18 and 20 are aligned so that receiving member 18 is located between receiving members 16 and 20 with members 16 and 20 being substantially the same and the mirror images of each other on either side of receiving member 18. Preferably, receiving member 16 is designed to hold an electrical connector 12, such as a jack and particularly a category 6 type jack with contact towers oriented in a horizontal direction with respect to the nose of the jack, as seen in FIG. 11. Likewise, receiving member 20 is designed to hold an electrical connector (not shown) similar to the electrical connector 12 held by receiving member 16. Receiving member 18, is designed to hold electrical connector 15, preferably a category 5 jack with contact towers oriented in a vertical direction with respect to the nose of the jack, as seen in FIG. 9. This allows tool 10 to support more than one type of electrical connector or jack.

Receiving members 16, 18, and 20 are each generally formed by four lateral upstanding spaced walls 32, 34, 36, and 38 extending from outer body support wall 24 with walls 34 and 36 being located between walls 32 and 38. In particular, receiving member 16 is defined between and by walls 32 and 34, receiving member 18 is defined between and by walls 34 and 36, and receiving member 20 is defined between and by walls 36 and 38. Lateral walls 32, 34, 36 and 38 preferably extend from support wall 24 approximately half of the length of height or peripheral wall 26 from support wall 24, as best seen in FIGS. 1 and 8. Also, lateral walls 32, 34, 36 and 38 are substantially perpendicular to a longitudinal axis 40 of outer body 14 and preferably centrally disposed on support wall 24. Additionally, lateral walls 32, 34, 36 and 38 extend for only a portion of the width of outer body 14, defined between first and second sides 42 and 44 of outer body peripheral wall 26, thereby leaving space between receiving members 16, 18 and 20 and peripheral wall sides 42 and 44, as seen in FIGS. 1 and 2.

Longitudinal walls 46 and 48 extend substantially parallel to outer body longitudinal axis 40 and close off the sides of the lateral walls 32, 34, 36 and 38 of receiving members 16, 18 and 20, as seen in FIGS. 1 and 2. Each longitudinal wall 46 and 48 preferably extends substantially the entire length of outer body 14, defined between first and second ends 50 and 52 of outer body 14, and terminates at lateral walls 32 and 38, respectively. A small space is preferably left between longitudinal walls 46 and 48 and each outer body end 50 and 52, as best seen in FIGS. 2 and 8.

Receiving member 16 includes first and second continuous portions 56 and 58 that together receive electrical connector 12, as best seen in FIGS. 2, 8 and 11, forming a generally rectangular compartment. First portion 56 is generally larger in both length and width to accommodate a first section 60 of electrical connector 12, such as the insulation displacement contact towers 63 and stuffer cap 64 of a jack, as seen in FIG. 11. Second portion 58 is adapted to accommodate a second section 62 of electrical connector 12, such as the head or input connection 66 of the jack, as seen in FIG. 11.

First portion 56 is particularly defined by lateral wall 34 and support wall 24 extending between longitudinal walls 46 and 48, with stuffer cap 64 of electrical connector first section 60 resting on support wall 24. Lateral wall 34 includes first and second lips 68 and 70 which extend toward the opposite lateral wall 32 of receiving member 16 for engaging electrical connector first section 60. Preferably, lips 68 and 70 abut the frame 72 of insulation displacement contact towers 63 of first section 60, as best seen in FIG. 11. Similarly, longitudinal walls 46 and 48 of receiving member 16 engage electrical connector 12 by abutting the sides of frame 72.

Figure 6:
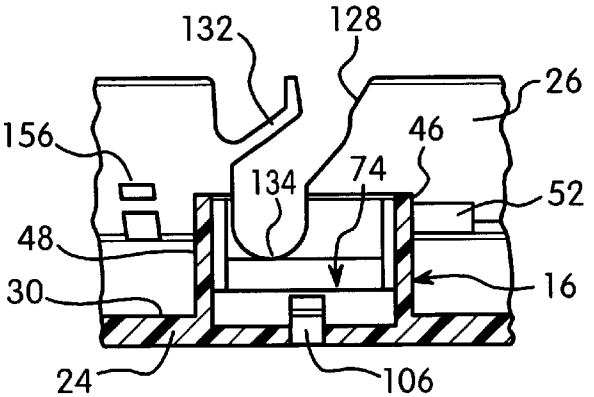
FIG. 6 is a partial, end elevational view in section of the tool taken along line 6—6 of FIG. 2.

Second portion 58 is particularly defined by lateral wall 32 and support wall 24 extending between longitudinal walls 46 and 48. The electrical connector second section 62 rests on a ledge 74 formed in support wall 24 and lateral wall 32, as seen in FIGS. 8 and 11, and extending between longitudinal walls 46 and 48, as seen in FIG. 6. Ledge 74 particularly includes a first step 76 extending from lateral wall 32 toward opposite lateral wall 34 and a second step 78 extending from first step 76 and down toward and meeting support wall 24. First step 76 supports the head 66 of electrical connector 12 and the drop between first and second steps 76 and 78 provides a space for accommodating a clip 80 of electrical connector 12, as seen in FIG. 11.

Preferably, the compartment formed by lateral walls 32 and 34 and longitudinal walls 46 and 48 of receiving member 16 releasably hold-electrical connector 12 by a frictional engagement by engaging the sides of the head 66 and frame 72 of connector 12. However, electrical connector 12 can simply rest in compartment 16 without engaging the walls 32, 34, 46 and 48.

Receiving member 18 is between receiving members 16 and 20, holds electrical connector 15, and forms a generally square compartment smaller than receiving member or compartment 16. In particular, lateral walls 34 and 36 and longitudinal walls 46 and 48 engage or abut the sides of the head or input connection 82 of the jack or electrical connector 15 to releasably hold electrical connector 15. Top portions 84 and 86 of walls 34 and 36 taper outwardly to accommodate the head 82 of the jack including a clip 88. Preferably, the compartment, formed by lateral walls 34 and 36 and longitudinal walls 46 and 48 of receiving member 18, is adapted to frictionally hold electrical connector 15. However, electrical connector 15 can simply rest in receiving member 18 without engaging the walls 34, 36, 46 and 48.

Receiving member 20 is substantially similar to member 16 and is the mirror image thereof. As with member 16, member 20 includes first and second continuous portions 90 and 92 that together receive an electrical connector (not shown) similar to electrical connector 12, forming a generally rectangular compartment. First and second portions 90 and 92 engage the electrical connector in the same manner as first and second portions 56 and 58 of member 16 engage electrical connector 12 and therefore will not be described.

First portion 90 is particularly defined by lateral wall 36 and support wall 24 extending between longitudinal walls 46 and 48. Like lateral wall 34, lateral wall 36 includes first and second lips 94 and 96 which extend toward the opposite lateral wall 38 of receiving member 20 for engaging a first section of the electrical connector in same manner as described above with respect to member 16.

Second portion 92 is particularly defined by lateral wall 38 and support wall 24 extending between longitudinal walls 46 and 48. A second section of the electrical connector rests on a ledge 100 formed in support wall 24 and lateral wall 38, as seen in FIGS. 1 and 2, and extending between longitudinal walls 46 and 48. Ledge 100 particularly includes a first step, similar to first step 76 of ledge 74, that extends from lateral wall 38 toward opposite lateral wall 36 and a second step, similar to second step 78 of ledge 74, that extends from the first step and down toward and meeting support wall 24. The first and second steps of ledge 100 support the electrical connector in the same manner as described above regarding electrical connector 12 and first and second steps 76 and 78 of member 16.

Preferably, the compartment formed by lateral walls 36 and 38 and longitudinal walls 46 and 48 of receiving member or compartment 20 releasably hold the electrical connector by a frictional engagement. However, the electrical connector can simply rest in compartment 20 without engaging the walls 36, 38, 46 and 48.

Figure 10:
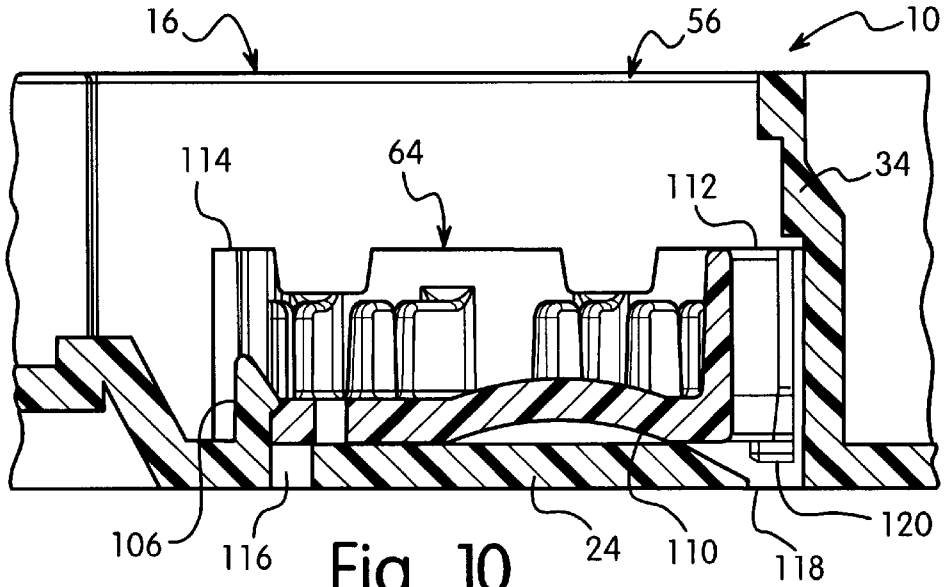
FIG. 10 is a partial, side elevational view in section of the tool illustrated in FIG. 1, showing a cap of an electrical connector coupled to the tool.

As seen in FIGS. 1, 2, 6, 8, 10 and 11, both receiving members 16 and 20 include a resilient tab 106 and 108 extending from support wall 24 for snapping engagement with the stuffer cap of each electrical connector held in receiving members 16 and 20, respectively, as seen in FIG. 10 (showing stuffer cap 64 of electrical connector 12 held in receiving member 16). Tabs 106 and 108 of receiving members 16 and 20 provide the operator with a mechanism for securing the stuffer cap of the electrical connector supported by either member 16 or 20 to tool 10 once the stuffer cap has been removed from the electrical connector after termination of cable wires to the electrical connector. By securing the stuffer cap to tool 10, the operator has a convenient place to store the stuffer cap until the stuffer cap is snapped onto the electrical connector after cable wires 22 have been terminated to the electrical connector.

Figure 4:
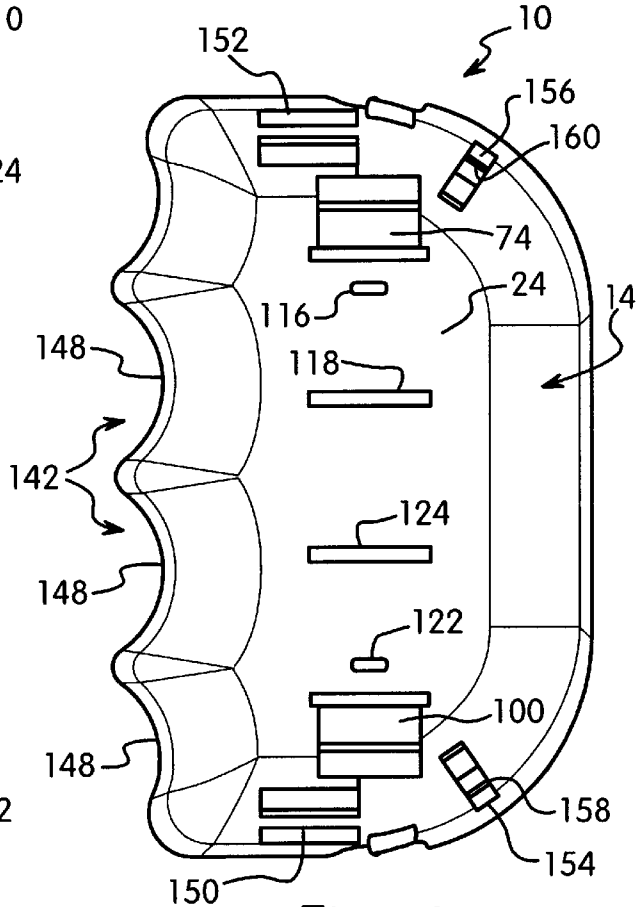
FIG. 4 is a bottom plan view of the tool illustrated in FIG. 1.
Figure 3:
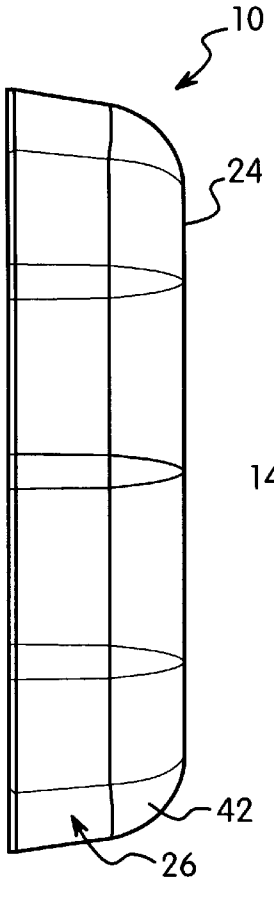
FIG. 3 is a side elevational view of the tool illustrated in FIG. 1.

For example, as seen in FIG. 10, once stuffer cap 64 is removed from electrical connector 12, stuffer cap 64 is inverted with a main wall 110 of cap 64 resting on support wall 24 in receiving member 16. A first end 112 of stuffer cap 64 abuts lateral wall 34 and a second end 114 engages tab 106. Specifically, tab 106 snaps onto main wall 110 at the second end 110 of stuffer cap 64. A hole 116 adjacent tab 106 allows insertion of a tool (not shown), such as a screw driver, to push up on main wall 110 and release stuffer cap 64 from engagement with tab 106, as seen in FIGS. 4 and 10. Also a slot 118 disposed between lateral wall 34 and support wall 24 that receives extensions 120 that extend from stuffer cap main wall 110, thereby allowing stuffer cap main wall 110 to be flush with support wall 24, as seen in FIG. 10.

Similarly, a stuffer cap of another electrical connector can be secured in receiving member 20 by tab 108 in the same manner as described above with respect to tab 106 and receiving member 16. In particular, once the stuffer cap is removed from the electrical connector, stuffer cap 64 is inverted with the main wall of the cap resting on support wall 24 in receiving member 20. A first end of the stuffer cap would abut lateral wall 36 and a second end would engage tab 108. Specifically, tab 108 would snap onto the cap main wall at the second end thereof. A hole 122, as seen in FIG. 4, adjacent tab 108 allows insertion of a tool (not shown), to push up on the cap main wall release the stuffer cap from engagement with tab 104. Also a slot 124 disposed between lateral wall 36 and support wall 24 receives extensions that extend from the stuffer cap main wall, thereby allowing the stuffer cap main wall to be flush with support wall 24.

As seen in FIGS. 1 and 6, first and second wire guide slots 126 and 128 are disposed in outer body peripheral wall 26 at first and second ends 50 and 52, respectively, for receiving and supporting cable wires. Both wire guide slots 126 and 128 are aligned with receiving members 16, 18, and 20, thereby aligning wires with an electrical connector received in one of members 16, 18 and 20. For example, first wire guide slot 126 supports and aligns cable wires 22 with receiving member 16, thereby facilitating alignment and termination of cable wires 22 with electrical connector 12 held in receiving member 16, as best seen in FIG. 1. Likewise, second wire guide slot 128 supports and aligns cable wires for termination with an electrical connector held in receiving member 20. Regarding electrical connector 15 held in receiving member 18, either wire guide slot 126 and 128 can be used to support and align cable wires with electrical connector 15. Also, each wire guide slot 126 and 128 includes an extension arm 130 and 132, respectively, for securing the cable wires in place in each wire guide slot 126 and 128.

Receiving members 16 and 20 each include third and fourth wire guide slots 134 and 136 corresponding to second and first wire guide slots 128 and 126, as best seen in FIGS. 1 and 6. In particular, outer lateral wall 32 of receiving member 16 includes third wire guide slot 134 that is aligned with second wire guide slot 128 disposed in second end 52, and outer lateral wall 38 of receiving member 20 includes fourth wire guide slot 136 that is aligned with first wire guide slot 126. For example, cable wires 22 are supported by first wire guide slot 126 in outer body first end 50 and by fourth wire guide slot 36 in lateral wall 38 of receiving member 20 to align cable wires 22 with electrical connector 12 held in receiving member 16. Similarly, cable wires are supported by second wire guide slot 128 in outer body second end 52 and third wire guide slot 134 in lateral wall 32 of receiving member 16 to align the cable wires with an electrical connector held in receiving member 20.

Figure 7:
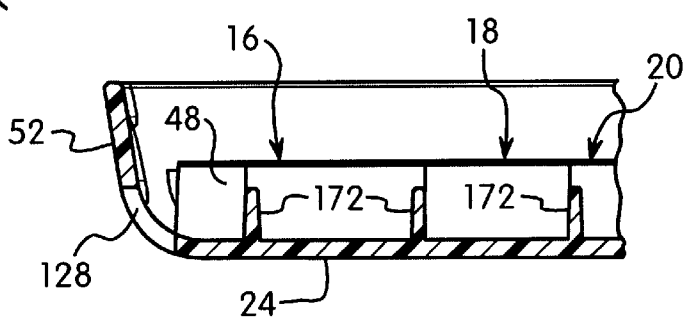
FIG. 7 is a partial, side elevational view in section of the tool taken along line 7—7 of FIG. 2.
Figure 5:
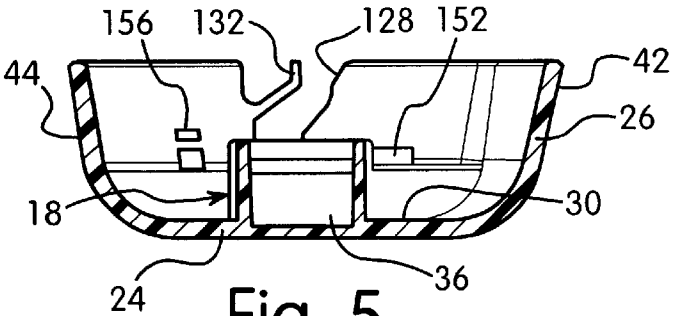
FIG. 5 is an end elevational view in section of the tool taken along line 5—5 of FIG. 2.

To facilitate gripping of tool 10, gripping indentations 142 are disposed in first side 42 of outer body peripheral wall 26, as seen in FIGS. 1, 2 and 4. The second side 44 opposite side 42 is generally flat at a middle portion 144 and rounded at each corner 146 providing an ergonomic fit for the operator's hand. Gripping indentations 142 particularly include generally four concave surfaces 148 adapted to accommodate the fingers of the operator, as seen in FIG. 7. Additionally, texturing (not shown) on the outer surface of peripheral wall can be added to provide another gripping surface for the operator when using tool 10. Also, strap openings 150 and 152 can be provided in peripheral wall 26 near each end 50 and 52, respectively, as best seen in FIG. 4, for receiving a strap (not shown) allowing an operator's hand to fit between the strap and tool 10 to provide an additional mechanism for the operator to hold tool 10. Additionally, openings 154 and 156 disposed near strap opening 150 and 152 in peripheral wall 26 having extension members 158 and 160 extending across each opening 150 and 152 for hooking a strap (not shown) or a lanyard (not shown) to tool 10 via extension members 158 and 160 allowing tool 10 to be connected to a structure such as the operator's tool belt.

As seen in FIGS. 1, 2 and 7, four sets of support ribs 162, 164, 166 and 168 extend along outer body support wall 24 to strengthen outer body 14. Each set of support ribs 162, 164, 166 and 168 are spaced from one another, are generally perpendicular to outer body longitudinal axis 40, and extend between first and second sides 42 and 44 of peripheral wall 26. First and fourth sets of support ribs 162 and 168 are located near outer body first and second ends 50 and 52, respectively. Second and third sets of ribs 164 and 166 are located between first and fourth sets of ribs 162 and 168 and are generally aligned with middle lateral walls 34 and 36. Each set of support ribs 162, 164, 166 and 168 includes two ribs 170 and 172 extending from longitudinal walls 46 and 48, respectively, towards peripheral wall sides 42 and 44, respectively. Ribs 170 and 172 extend upwardly from support wall 24 for at least half of the height of longitudinal walls 46 and 48, as best seen in FIG. 7 (showing ribs 172 only).

Support wall 24 additionally includes mounting holes 174 for receiving fasteners to mount tool 10 to a support structure (not shown), such as a relay rack, for terminating cable wires to the electrical connectors instead of supporting tool 10 in the operators hand. Preferably, six mounting holes 174 are disposed in support wall 24 with three mounting holes 174 being located between longitudinal wall 46 and peripheral wall first side 42 and the other three mounting holes 174 being located between longitudinal wall 48 and peripheral wall second side 44, as best seen in FIG. 2. A cover (not shown) can be provided on outer body 14 to enclose fasteners or the like within receiving area 28 of outer body 14.

Tool 10 is preferably formed of a plastic material and molded as a unitary one-piece member. However, the components of tool 10 can be formed separately and integrally attached by any known attachment.

Assembly and Operation

Referring to FIGS. 1–11, operation of tool 10 generally involves the operator holding tool 10 in the operator's hand, placing an electrical connector within tool 10, and terminating cable wires to the electrical connector with a punch down tool, using tool 10 to support the electrical connector during termination instead of the operator's hand.

Tool 10 fits in the operator's hand allowing the operator to easily grab tool 10 with support wall 24 fitting in the base or palm of the operator's hand and the operator's fingers grabbing gripping indentations 142. An electrical connector can be placed in one of the tool receiving members 16, 18 and 20 in preparation for termination. For example, electrical connector 12 is placed in receiving member 16 by inserting first section 60 of electrical connector 12 into first portion 56 of receiving member 16 and second section 62 into second portion 58 so that the stuffer cap 64 rests on support wall 24 and the 66 head rests on first step 76 of ledge 74 so that electrical connector 12 is generally secured within receiving member 16 via a frictional fit with lateral walls 32 and 34 and longitudinal walls 46 and 48.

A cable C is placed within first wire guide slot 126 disposed in outer body first end 50 and corresponding fourth wire guide slot 136 disposed in lateral wall 38 of receiving member 20. Cable wires or pairs 22 are then fanned out to the appropriate wiring configuration for tower lacing, and laced into towers 63 of electrical connector 12, as is well known in the art. A standard punch down tool is held perpendicular to electrical connector 12 and terminates or connects the laced cable wires 22 to towers 63, as is well known in the art. Once termination is complete, electrical connector 12 is removed from receiving member 16, and stuffer cap 64 is removed from electrical connector 12 and snapped onto towers 63. By using tool 10, the operator reduces the potential for injury caused by misuse or slipping of the punch down tool.

Similarly, an electrical connector can be placed in receiving member 20 in the same manner as described above with respect to electrical connector and receiving member 16. In particular, the electrical connector is placed in receiving member 20 by inserting the first section of the electrical connector into first portion 90 of receiving member 20 and the second section into second portion 92 so that the stuffer cap rests on support wall 24 and the 66 head rests on the first step of ledge 100 so that electrical connector is generally secured within receiving member 20 via a frictional fit with lateral walls 36 and 36 and longitudinal walls 46 and 48.

A cable can then be placed within second wire guide slot 128 disposed in outer body second end 50 and corresponding third wire guide slot 134 disposed in lateral wall 32 of receiving member 16. Cable wires or pairs are then laced into towers of the electrical connector, as describe with respect to electrical connector 12. A standard punch down tool is held perpendicular to the electrical connector and terminates or connects the laced cable wires the towers of the electrical connectors. Once termination is complete, the electrical connector is removed from receiving member 20, and the stuffer cap is removed from the electrical connector and snapped onto the electrical connector.

Additionally, electrical connector 15 can be placed in receiving member 18 by inserting the head 82 of connector 15, including clip 80, within the compartment formed by lateral walls 34 and 36 and longitudinal walls 46 and 48 of receiving member 18 forming a frictional fit therewith. A cable can then be placed within either first or second wire guide slots 126 and 128 disposed in outer body ends 50 and 52, and within their respective corresponding fourth and third wire guide slots 136 and 134 disposed in lateral walls 38 and 32. Cable wires or pairs are then terminated to electrical connector in the same manner as describe above with respect to electrical connector 12.

As seen in FIG. 10, if the operator needs a convenient place to store the stuffer cap 64 of electrical connector 12 or the stuffer cap of the connector held by receiving member 20 until the cap can be snapped onto the towers of the connector, such as towers 63 of electrical connector 12, after termination, the stuffer cap is inverted and snapped onto either tab 106 of receiving member 16 or tab 108 of receiving member 20. For example, stuffer cap 64 of connector 12 is inverted and placed within first portion 56 of receiving member 16 and snapped onto tab 106. To remove stuffer cap 64, a tool, such as a screw driver is inserted through hole 116 adjacent tab 106 which pushes on stuffer cap 64 to release cap 64 from tap 106. Similarly, a stuffer cap can also be coupled to tab 108 of receiving member 20 in the same manner as described above.

As an alternative to holding tool 10 via the operator's hand, tool 10 can be mounted to a support structure, such as a relay rack. In particular, fasteners can be inserted through mounting holes 174 and into holes of the support structure, thereby mounting tool 10 to the support structure. Tool 10 is preferably mounted so that longitudinal axis 40 of outer body 14 is generally horizontal. Electrical connector 12 can then placed in receiving member 16 and cable wires 22 terminated thereto, in the same manner as described above.

While a particular embodiment has been chosen to illustrate the invention, it will be understood by those skilled in the art that various changes and modifications can be made therein without departing from the scope of the invention as defined in the appended claims.

What is claimed is:

1. A tool for terminating wires to electrical connectors, comprising:

an outer body configured to fit with an operator's hand, and including first and second walls spaced from a peripheral wall;

a first receiving member mounted in said outer body and defined between said first and second walls for releasably holding an electrical connector in place within said outer body; and a first wire guide slot located at a first end of said outer body remote from said first receiving member, said first slot being aligned with said first receiving member to align wires located in said first slot with the electrical connector held by said first receiving member.

2. A tool according to claim 1, wherein a second receiving member is aligned with said first receiving member for releasably holding an electrical connector in place within said outer body.

3. A tool according to claim 2, wherein a second wire guide slot is located at a second end of said outer body remote from said second receiving member, said second slot is aligned with said second receiving member to align wires located in said second slot with the electrical connector held by the second receiving member.

4. A tool according to claim 3, wherein said first and second receiving members include third and fourth wire guide slots, respectively;

said third wire guide slot cooperating with said second wire guide slot to align wires located in the second slot with the electrical connector held by the second receiving member; and said fourth wire guide slot cooperating with said first wire guide slot to align wires located in the first slot with the electrical connector held by the first receiving member.

5. A tool according to claim 3, wherein a third receiving member is disposed between said first and second receiving members for releasably holding an electrical connector in place within said outer body.

6. A tool according to claim 1, wherein said first and second walls frictionally engage the electrical connector received therein.

7. A tool according to claim 1, wherein said first receiving member defines a compartment that holds the electrical connector and includes a ledge therein for supporting the electrical connector.

8. A tool according to claim 1, wherein said first receiving member includes a resilient tab adapted to engage a portion of the electrical connector by a snapping engagement.

9. A tool according to claim 8, wherein said tab is unitary with said outer body.

10. A tool according to claim 1, wherein said outer body includes a peripheral wall having gripping indentations for accommodating fingers of the operator's hand thereby facilitating gripping of said outer body.

11. A tool according to claim 1, wherein said outer body includes a second end opposite said first end; and each of said first and second ends, respectively, includes a strap opening for receiving a strap.

12. A tool according to claim 1, wherein said outer body includes a main support wall;

said first receiving member is disposed on said support wall; and a plurality of mounting openings are disposed in said main support wall for mounting said outer body to a support structure.

13. A tool for terminating wires to electrical connectors, comprising:

an outer body configured to fit with an operator's hand having a compartment disposed therein and spaced from a peripheral wall of said outer body;

an electrical connector received within said compartment of said outer body; and a wire guide slot located at an end of said outer body remote from said compartment, said slot receiving wires and being aligned with said compartment thereby aligning said wires located in said slot with said electrical connector held by said compartment.

14. A tool according to claim 13, wherein said compartment includes at least first and second walls that frictionally engage said electrical connector.

15. A tool according to claim 14, wherein said outer body includes a peripheral wall having gripping indentations for accommodating fingers of the operator's hand thereby facilitating gripping of said outer body.

16. A tool for terminating wires to electrical connectors, comprising;

an outer body configured to fit with an operator's hand, said outer body including a main support wall having an outer edge and a peripheral wall extending from said outer edge forming a receiving area therebetween;

first and second compartments mounted on said main support wall and in said receiving area of said outer body for releasably holding electrical connectors in place within said receiving area of said outer body with at least one wall dividing said first and second compartments; and first and second wire guide slots located at opposite ends of said outer body, said first slot being remote from and aligned with said first compartment to align wires located in said first slot with the electrical connector held by the first compartment, and said second slot being remote from and aligned with said second compartment to align wires located in said second slot with the electrical connector held by the second compartment.

17. A tool according to claim 16, wherein a third compartment is disposed between said first and second compartments for releasably holding an electrical connector; and said first and second slots being aligned with said third compartment for aligning wires held in either of said first and second slots with the electrical connector held by said third compartment.

18. A tool according to claim 17, wherein each of said first, second, and third compartments, respectively, include at least first and second walls forming a friction fit with the electrical connectors held by said first, second, and third compartments, respectively.

19. A tool according to claim 16, wherein a plurality of mounting openings are disposed in said main support wall for mounting said outer body to a support structure.

20. A tool according to claim 16, wherein said peripheral wall includes gripping indentations for accommodating fingers of the operator's hand thereby facilitating gripping of said outer body.

21. A tool according to claim 16, wherein said outer body is formed as a unitary one-piece member.

22. A tool according to claim 16, wherein said peripheral wall of said outer body extends substantially perpendicularly from said main support wall to protect the operator's hand from injury.

23. A tool for terminating wires to electrical connectors, comprising:

an outer body configured to fit with an operator's hand;

a first receiving member mounted in said outer body for releasably holding at least one electrical connector in place within said outer body;

a second receiving member aligned with said first receiving member for releasably holding at least one electrical connector in place within said outer body; and a first wire guide slot located at a first end of said outer body remote from said first receiving member, said first slot being aligned with said first and second receiving members.

24. A tool according to claim 23, wherein a second wire guide slot is located at a second end of said outer body remote from said second receiving member, said second slot being aligned with said second receiving member to align wires located in said second slot with the electrical connector held by the second receiving member.

25. A tool for terminating wires to electrical connectors, comprising:

an outer body configured to fit with an operator's hand;

a first receiving member mounted in said outer body for releasably holding an electrical connector in place within said outer body;

a second receiving member aligned with said first receiving member for releasably holding an electrical connector in place within said outer body;

a first wire guide slot located at a first end of said outer body remote from said first receiving member, said first slot being aligned with said first receiving member to align wires located in said first slot with the electrical connector held by said first receiving member;

a second wire guide slot located at a second end of said outer body remote from said second receiving member, said second slot being aligned with said second receiving member to align wires located in said second slot with the electrical connector held by the second receiving member;

a third wire guide slot cooperating with said second wire guide slot to align wires located in said second slot with the electrical connector held by said second receiving member; and a fourth wire guide slot cooperating with said first wire guide slot to align wires located in said first slot with the electrical connector held by said first receiving member.

26. A tool according to claim 25, wherein a third receiving member is disposed between said first and second receiving members for releasably holding an electrical connector in place within said outer body.

27. A tool according to claim 25, wherein said first receiving member includes first and second walls that frictionally engage the electrical connector received therein.

28. A tool according to claim 25, wherein said first receiving member defines a compartment that holds the electrical connector and includes a ledge therein for supporting the electrical connector.

29. A tool according to claim 25, wherein said outer body includes a peripheral wall having gripping indentations for accommodating fingers of the operator's hand thereby facilitating gripping of said outer body.

30. A tool according to claim 25, wherein said outer body includes a second end opposite said first end; and each of said first and second ends, respectively, includes a strap opening for receiving a strap.

31. A tool for terminating wires to electrical connectors, comprising:

an outer body configured to fit with an operator's hand;

a first receiving member mounted in said outer body for releasably holding an electrical connector in place within said outer body;

a second receiving member aligned with said first receiving member for releasably holding an electrical connector in place within said outer body;

a third receiving member disposed between said first and second receiving members for releasably holding an electrical connector in place within said outer body;

a first wire guide slot located at a first end of said outer body remote from said first receiving member, said first slot being aligned with said first receiving member to align wires located in said first slot with the electrical connector held by said first receiving member; and a second wire guide slot located at a second end of said outer body remote from said second receiving member, said second slot being aligned with said second receiving member to align wires located in said second slot with the electrical connector held by the second receiving member.

32. A tool according to claim 31, wherein said first receiving member includes first and second walls that frictionally engage the electrical connector received therein.

33. A tool according to claim 31, wherein said first receiving member defines a compartment that holds the electrical connector and includes a ledge therein for supporting the electrical connector.

34. A tool according to claim 31, wherein said outer body includes a peripheral wall having gripping indentations for accommodating fingers of the operator's hand thereby facilitating gripping of said outer body.

35. A tool according to claim 31, wherein said outer body includes a second end opposite said first end; and each of said first and second ends, respectively, includes a strap opening for receiving a strap.

36. A tool for terminating wires to electrical connectors, comprising:

an outer body configured to fit with an operator's hand;

a first receiving member mounted in said outer body for releasably holding an electrical connector in place within said outer body and defining a compartment that holds the electrical connector including a ledge therein for supporting the electrical connector; and a first wire guide slot located at a first end of said outer body remote from said first receiving member, said first slot being aligned with said first receiving member to align wires located in said first slot with the electrical connector held by said first receiving member.

37. A tool according to claim 36, wherein a second receiving member is aligned with said first receiving member for releasably holding an electrical connector in place within said outer body.

38. A tool according to claim 37, wherein a second wire guide slot is located at a second end of said outer body remote from said second receiving member, said second slot being aligned with said second receiving member to align wires located in said second slot with the electrical connector held by the second receiving member.

39. A tool according to claim 36, wherein said first receiving member includes first and second walls that frictionally engage the electrical connector received therein.

40. A tool according to claim 36, wherein said outer body includes a peripheral wall having gripping indentations for accommodating fingers of the operator's hand thereby facilitating gripping of said outer body.

41. A tool according to claim 36, wherein said outer body includes a second end opposite said first end; and each of said first and second ends, respectively, includes a strap opening for receiving a strap.

42. A tool for terminating wires to electrical connectors, comprising:

an outer body configured to fit with an operator's hand and including a peripheral wall having gripping indentations for accommodating fingers of the operator's hand thereby facilitating gripping of said outer body;

a first receiving member mounted in said outer body for releasably holding an electrical connector in place within said outer body; and a first wire guide slot located at a first end of said outer body remote from said first receiving member, said first slot being aligned with said first receiving member to align wires located in said first slot with the electrical connector held by said first receiving member.

43. A tool according to claim 42, wherein a second receiving member is aligned with said first receiving member for releasably holding an electrical connector in place within said outer body.

44. A tool according to claim 43, wherein a second wire guide slot is located at a second end of said outer body remote from said second receiving member, said second slot is aligned with said second receiving member to align wires located in said second slot with the electrical connector held by the second receiving member.

45. A tool according to claim 42, wherein said first receiving member includes first and second walls that frictionally engage the electrical connector received therein.

46. A tool according to claim 42, wherein said outer body includes a second end opposite said first end; and each of said first and second ends, respectively, includes a strap opening for receiving a strap.

47. A tool for terminating wires to electrical connectors, comprising:

an outer body configured to fit with an operator's hand and including first and second opposite ends;

a first receiving member mounted in said outer body for releasably holding an electrical connector in place within said outer body;

a first wire guide slot located at a first end of said outer body remote from said first receiving member, said first slot being aligned with said first receiving member to align wires located in said first slot with the electrical connector held by said first receiving member; and a strap opening at each of said first and second ends, respectively, of said outer body for receiving a strap.

48. A tool according to claim 47, wherein a second receiving member is aligned with said first receiving member for releasably holding an electrical connector in place within said outer body.

49. A tool according to claim 48, wherein a second wire guide slot is located at a second end of said outer body remote from said second receiving member, said second slot being aligned with said second receiving member to align wires located in said second slot with the electrical connector held by the second receiving member.

50. A tool according to claim 47, wherein said first receiving member includes first and second walls that frictionally engage the electrical connector received therein.

51. A tool for terminating wires to electrical connectors, comprising:

an outer body configured to fit with an operator's hand having a compartment disposed therein with first and second walls, and a peripheral wall with gripping indentations for accommodating fingers of the operator's hand thereby facilitating gripping of said outer body;

an electrical connector received within said compartment of said outer body with said first and second walls frictionally engaging said electrical connector; and a wire guide slot located at an end of said outer body remote from said compartment, said slot receiving wires and being aligned with said compartment thereby aligning said wires located in said slot with said electrical connector held by said compartment.

52. A tool for terminating wires to electrical connectors, comprising;

an outer body configured to fit with an operator's hand, said outer body including a main support wall having an outer edge and a peripheral wall extending from said outer edge forming a receiving area therebetween;

first and second compartments mounted on said main support wall and in said receiving area of said outer body for releasably holding electrical connectors in place within said receiving area of said outer body;

a third compartment disposed between said first and second compartments for releasably holding an electrical connector; and first and second wire guide slots located at opposite ends of said outer body, said first slot being remote from and aligned with said first compartment to align wires located in said first slot with the electrical connector held by the first compartment, said second slot being remote from and aligned with said second compartment to align wires located in said second slot with the electrical connector held by the second compartment, and said first and second slots being aligned with said third compartment for aligning wires held in either of said first and second slots with the electrical connector held by said third compartment.

53. A tool according to claim 52, wherein each of said first, second, and third compartments, respectively, include at least first and second walls forming a friction fit with the electrical connectors held by said first, second, and third compartments, respectively.

54. A tool according to claim 52, wherein said peripheral wall includes gripping indentations for accommodating fingers of the operator's hand thereby facilitating gripping of said outer body.

55. A tool for terminating wires to electrical connectors, comprising;

an outer body configured to fit with an operator's hand, said outer body including a main support wall having an outer edge and a peripheral wall extending from said outer edge forming a receiving area therebetween and gripping indentations for accommodating fingers of the operator's hand thereby facilitating gripping of said outer body;

first and second compartments mounted on said main support wall and in said receiving area of said outer body for releasably holding electrical connectors in place within said receiving area of said outer body; and first and second wire guide slots located at opposite ends of said outer body, said first slot being remote from and aligned with said first compartment to align wires located in said first slot with the electrical connector held by the first compartment, and said second slot being remote from and aligned with said second compartment to align wires located in said second slot with the electrical connector held by the second compartment.

56. A tool according to claim 55, wherein a third compartment is disposed between said first and second compartments for releasably holding an electrical connector;

each of said first, second, and third compartments, respectively, include at least first and second walls forming a friction fit with the electrical connectors held by said first, second, and third compartments, respectively; and said first and second slots are aligned with said third compartment for aligning wires held in either of said first and second slots with the electrical connector held by said third compartment.

* * * * *